US006884103B1

(12) United States Patent
Kovacs

(10) Patent No.: US 6,884,103 B1
(45) Date of Patent: Apr. 26, 2005

(54) SECURE LAMP BASE AND SOCKET

(75) Inventor: George Kovacs, Wallingford, CT (US)

(73) Assignee: Light Sources, Inc., Orange, CT (US)

( * ) Notice: Subject to any disclaimer, the term of this patent is extended or adjusted under 35 U.S.C. 154(b) by 0 days.

(21) Appl. No.: 10/771,945

(22) Filed: Feb. 4, 2004

(51) Int. Cl.[7] ..... H01R 4/50; F21V 19/02
(52) U.S. Cl. ..... 439/336; 362/220; 439/337
(58) Field of Search ..... 439/335–337, 439/168, 220; 250/436; 362/220, 217, 260

(56) References Cited

U.S. PATENT DOCUMENTS 2,571,881 A * 10/1951 Howard ..... 439/337
2,844,672 A * 7/1958 Sambonet ..... 200/51.09
3,363,217 A * 1/1968 Garver et al. ..... 439/337
5,422,487 A 6/1995 Sauska et al. ..... 250/436
5,823,806 A * 10/1998 Nagase et al. ..... 439/140
6,634,902 B1 10/2003 Pirovic ..... 439/337
6,779,911 B1 * 8/2004 Chang ..... 362/430
2002/0163812 A1 * 11/2002 Tseng ..... 362/404

* cited by examiner

*Primary Examiner*—Michael C. Zarroli
(74) *Attorney, Agent, or Firm*—Fattibene & Fattibene; Paul A. Fattibene; Arthur T. Fattibene

(57) ABSTRACT

A lamp base and mating socket locking to prevent axial separation. A lamp base has a locking bridge with arms extending between pairs of contact pins spaced a distance from a surface of the lamp base forming a gap. The contact pins and locking bridge extend through an opening in the socket. Upon rotating the lamp base relative to the socket, locking lands extend under the arms of the locking bridge in the gap preventing unintentional axial separation between the lamp base and the socket. In one embodiment, a key notch is formed in one of the arms of the locking bridge and a mating key pin is formed on the lamp base. The present invention is particularly suited to environments susceptible to vibration or movement; for example, in the treatment of wastewater.

18 Claims, 6 Drawing Sheets

SECURE LAMP BASE AND SOCKET

FIELD OF THE INVENTION

The present invention relates in general to a lamp base and socket used for securing a lamp, and in particular to a locking base and socket for gas discharge lamps, such as fluorescent lamps and germicidal lamps.

BACKGROUND OF THE INVENTION

There are many different types of lamps that have a base adapted to be placed within a socket to provide electrical connections to lamps. The base and socket must be constructed to permit easy replacement of the lamp and yet securely hold the lamp. This may be particularly important in certain applications where vibration or movement of the lamp or lamp fixture could result in unintentional separation between the base of the lamp and the socket. Additionally, the electrical connections must remain secure.

In some applications where a multitude of contact pins are utilized, it is often difficult to align the contact pins to make the electrical connection necessary to operate the lamp. Often, the contact pins may become misaligned or bent due to their extension or projection from the base of the lamp, preventing their insertion into a socket. It may also be possible to insert the lamp base into a socket such that the contact pins are not placed within the correct hole, resulting in improper or non-operation of the lamp.

U.S. Pat. No. 5,422,487 entitled "Waste Water Purification System With Complementary Interlocking Germicidal Lamp and Socket Construction" issuing to Sauska et al on Jun. 6, 1995, discloses an interlocking lamp and socket construction utilizing keyhole slots and contact pins having a contact disc attached thereto. Another connector is disclosed in U.S. Pat. No. 6,634,902 entitled "Purification Lamp Connector" issuing to Parovic on Oct. 21, 2003. Therein disclosed is a high voltage insulation plug having axial passageways, each containing an axially movable contact spring so configured that when the plug is rotated, protrusions are rotated under shoulders in the socket adjacent the passageways.

While these prior lamp connectors have proven beneficial in some applications, they do not provide a sufficiently secure connection in other applications. Additionally, there is little protection from bending the axially extending pins in prior connectors. The prior connectors also generally require a contact pin having a contact disc or hat in order to provide a secure connection. This often results in a contact pin that is expensive and difficult to manufacture.

Therefore, there is a need for improved lamp base and socket construction that can securely hold the lamp and prevent damage to the pin contacts.

SUMMARY OF THE INVENTION

The present invention relates to a lamp base having a plurality of pins and a socket or fixture for receiving the lamp base. A plurality of contact pins extend axially from the lamp base. A locking bridge or pin support extends between pairs of the contact pins. A gap is formed between the locking bridge and a surface of the lamp base. A lamp socket has an opening therein for receiving the contact pins and the locking bridge. Spring contacts are positioned to electrically connect to the plurality of contact pins. Locking lands are positioned to move into the gap formed between the surface of the lamp base and the locking bridge placed between pairs of the plurality of contact pins.

In another embodiment, a key notch is formed on one of the locking bridges and a mating key pin is formed on one of the locking lands so as to permit the lamp base to fit within the lamp socket in only one angular orientation.

Accordingly, it is an object of the present invention to provide a secure connection between a lamp base and a lamp fixture.

It is another object of the present invention to protect the contact pins extending axially from a lamp base.

It is yet another object of the present invention to prevent an improper connection between the lamp base and the lamp socket.

It is an advantage of the present invention that unintentional separation of the lamp base and the lamp socket is prevented.

It is yet another advantage of the present invention that the contact pins are prevented from being damaged or bent.

It is another advantage of the present invention that in one embodiment the lamp base and the lamp socket can only be connected in a predetermined angular orientation.

It is a feature of the present invention that a locking bridge extends between pairs of contact pins.

It is another feature of the present invention that a gap is formed between the surface of the lamp socket and the locking bridge.

It is another feature of the present invention that a key notch is formed in the locking bridge and a key pin is formed in a locking land on the lamp socket.

These and other objects, advantages, and features will become readily apparent in view of the following more detailed description.

DETAILED DESCRIPTION OF THE PREFERRED EMBODIMENTS

Figure 1:
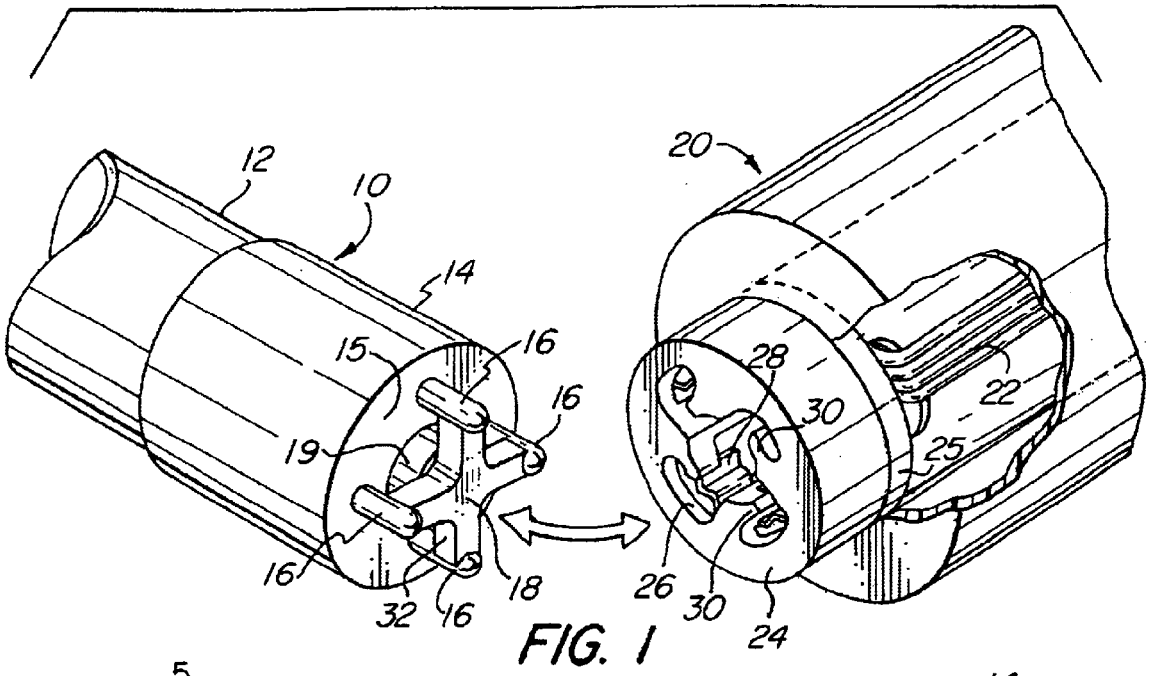
FIG. 1 is a perspective view schematically illustrating a lamp and fixture of the present invention.

FIG. 1 illustrates one embodiment of the present invention. A lamp 10 has a glass envelope 12 and a lamp base 14. The lamp 10 may be any type of lamp, such as a fluorescent lamp or germicidal lamp, generally having a tubular glass envelope with electrodes for producing an electric arc therebetween. The lamp base 14 has a plurality of contact pins 16 axially extending therefrom. The plurality of contact pins 16 extend from surface 15. Also extending from surface 15 is a locking bridge base 19. Placed on the locking bridge base 19 is locking bridge 18. The locking bridge 18 has arms 32 extending between pairs of the plurality of contact pins 16. The locking bridge 18 is made of an insulating material so as to prevent an electrical connection between pairs of contact pins 16. An underpass, space or gap is formed between the surface 15 and the arms 32 of the locking bridge 18.

Fixture 20 is adapted to receive the lamp base 14. Fixture 20 has electrical wires 22 connected to the socket 24. The socket 24 has a configured opening 26. The opening 26 has a shape to receive the locking bridge 18 and the plurality of pins 26. Spring contacts 28 are adapted to make electrical contact with a respective one of the plurality of contact pins 16. Locking tabs 30 are formed from a part of the opening 26. A cover 25 may be used to seal the socket 24. The opening 26 is shaped so as to receive the locking bridge 18 and the plurality of pins 16 and to permit the lamp base 14 to be rotated relative to the socket 24. Locking lands 30, upon rotation, extend under the arms 32 of the locking bridge 18, preventing the lamp 10 from being unintentionally separated in an axial direction from the fixture 20. Additionally, the arms 32 extending between opposing pairs of the plurality of contact pins 16 help to protect the plurality of contact pins 16. The arms 32 help to prevent the possibility of the plurality of contact pins 16 from becoming bent or damaged.

Figure 2:
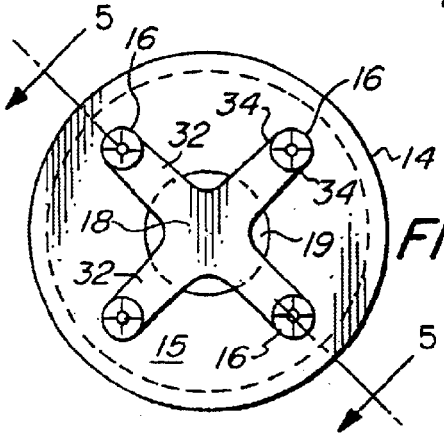
FIG. 2 is a front elevational view of the lamp base.

FIG. 2 is a front elevational view illustrating the locking bridge 18 and arms 32 extending between pairs of the plurality of contact pins 16. Arms 32 are mounted on the locking bridge base 19. A gap extends between the locking bridge base 19 and the plurality of contact pins 16 under the arms 32. The arms 32 may also have fingers 34 that extend around a partial circumferential portion of each of the plurality of contact pins 16.

Figure 3:
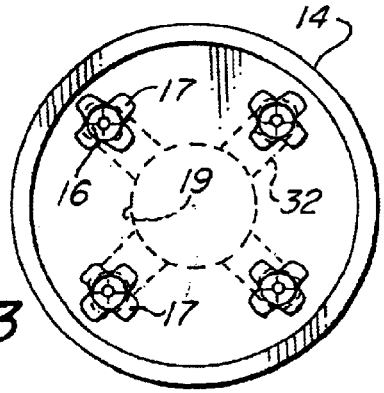
FIG. 3 is a rear elevational view of the lamp base.

FIG. 3 is a rear elevational view illustrating the inside of the lamp base 14. Contact pins 16 extend through the lamp base 14 and may have a pin flange 17 for holding the contact pins 16 to the lamp base 14. One of the electrical wires 22, illustrated in FIG. 1, is electrically connected to a respective contact pin 16. It should be appreciated that while the present invention is described with respect to a preferred embodiment having four contact pins, the present invention could easily be adapted to a base and socket combination having any number of contact pins, for example, two or more than four.

Figure 4:
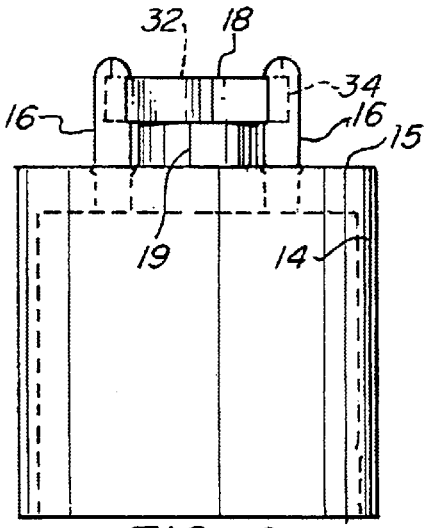
FIG. 4 is a side elevational view illustrating the lamp base.

FIG. 4 is a side elevational view illustrating the lamp base 14. The locking bridge 18 and the arms 32 are raised above the surface 15.

Figure 5:
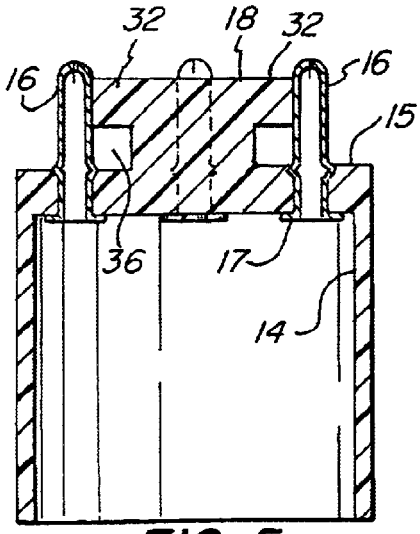
FIG. 5 is a cross section taken along line 6—6 in FIG. 2.

FIG. 5 is a cross section taken along lines 6—6 in FIG. 2. The underpass, space, or gap 36 is more clearly illustrated in FIG. 5. The gap 36 is formed between the arms 32 and surface 15 of the lamp base 14.

Figure 6:
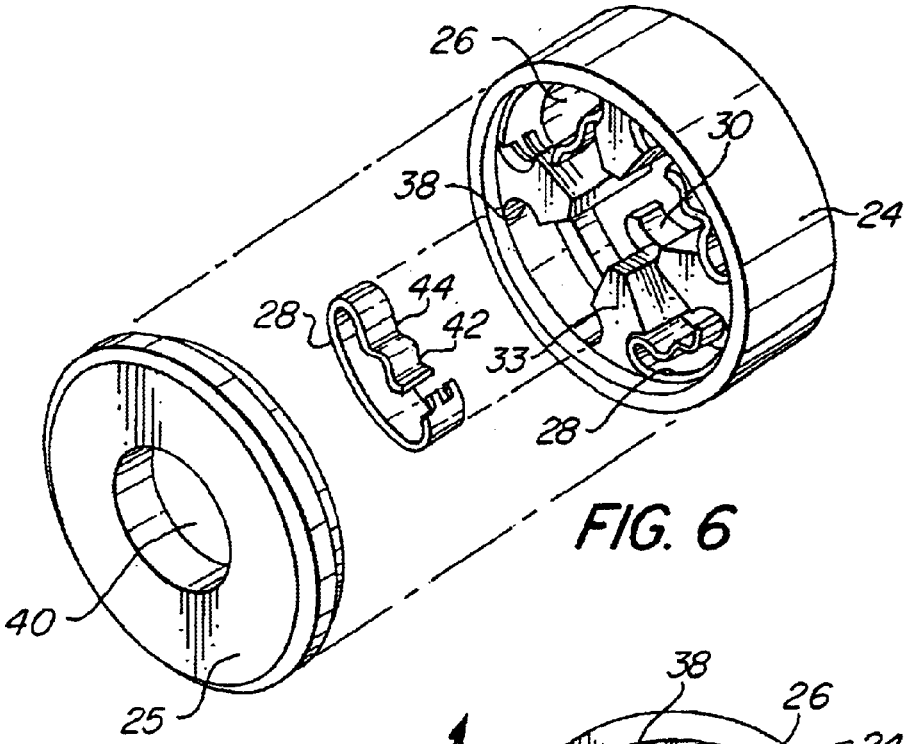
FIG. 6 is a perspective exploded view of the lamp socket.

FIG. 6 is a partial exploded view illustrating the socket 24. The socket 24 has a depression or slot 38 formed therein to receive a spring contact 28. The spring contact 28 has a first recess 42 and a second recess 44. Between each of the spring contacts 28 is a stop 33. Formed on the stop 33 are the locking lands 30. A cover 25 may be placed on the socket 24 to protect the rear portion thereof. A hole 40 in the cover 25 permits contact wires, not illustrated, to pass therethrough. The contact wires, not illustrated, are used to electrically power the lamp once secured within the socket 24.

Figure 7:
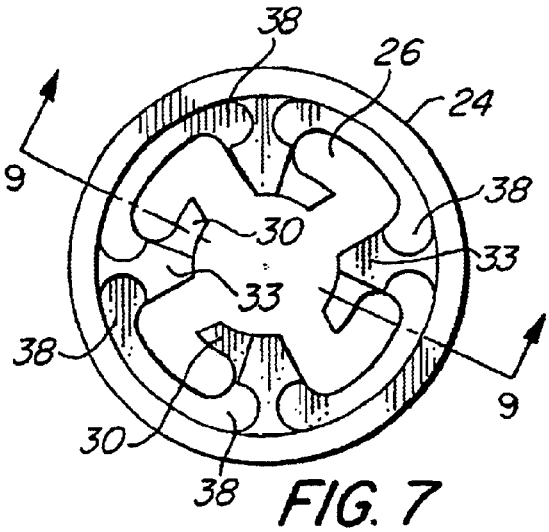
FIG. 7 is a rear elevational view of the interior of the lamp socket without any spring contacts.

FIG. 7 is a rear elevational view of the socket 24. Formed within the socket 24 are a plurality of spring clip slots 38 for holding a spring clip adjacent the opening 26. Between each of the spring clip slots 38 is a stop 33 having a locking land 30 formed thereon.

Figure 8:
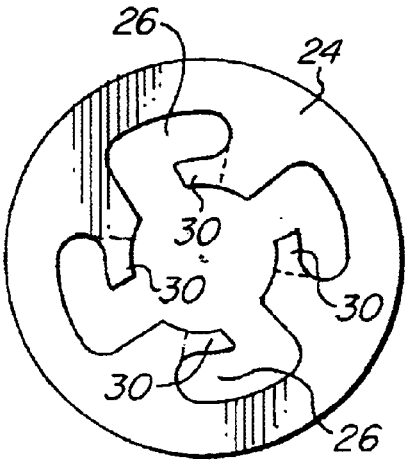
FIG. 8 is a front elevational view of the lamp socket without any spring contacts.

FIG. 8 is a front elevational view illustrating the opening 26 in the socket 24. Additionally, illustrated are the associated locking lands 30.

Figure 9:
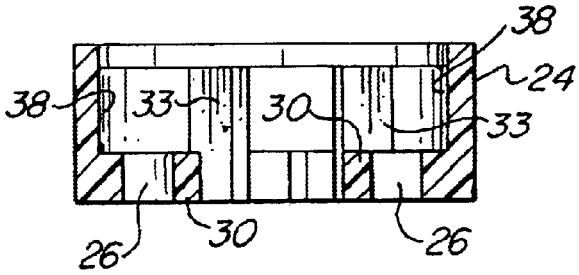
FIG. 9 is a cross section taken along line 9—9 in FIG. 7.

FIG. 9 is a cross section taken along line 9—9 in FIG. 7. FIG. 9 more clearly illustrates the different levels between the locking lands 30 and the stop 33.

Figure 10A:
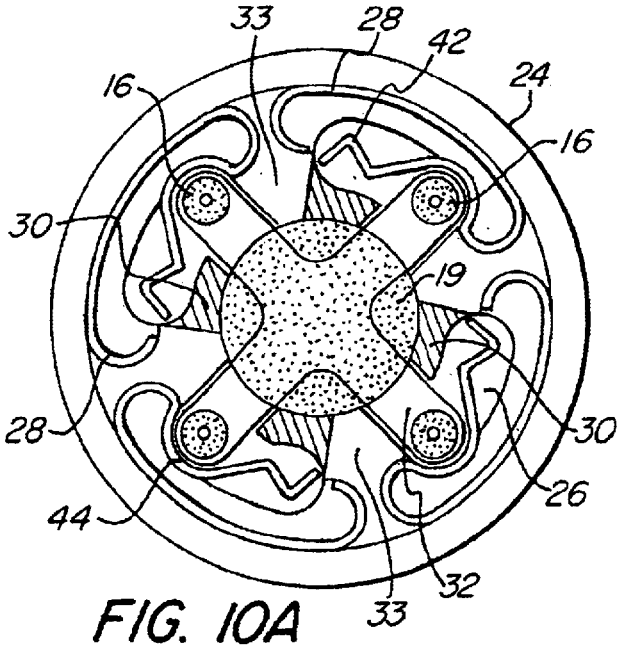
FIG. 10A is a plan view schematically illustrating the operation of the present invention in a first unlocked position.
Figure 10B:
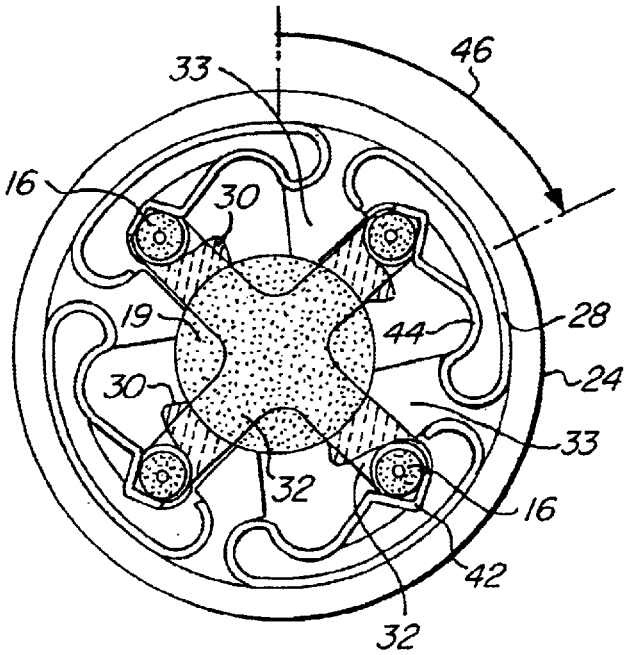
FIG. 10B is a plan view schematically illustrating the operation of the present invention in a locked position.

FIGS. 10A and 10B schematically illustrate the operation of the present invention. FIG. 10A illustrates the present invention in an unlocked position. FIG. 10B illustrates the present invention rotated by an angle, illustrated by arrow 46, so as to be angularly positioned in a locked position. As illustrated in FIG. 10A, the arms 32 on the lamp base are inserted through the opening 26 formed in the socket 24. Each of the plurality of the contact pins 16 line up with a second recess 44 in the spring clips 28. Each of the arms 32 are positioned between the stop 33 and the locking land 30. In this unlocked position, the locking lands 30 do not extend under the arms 32. Therefore, the lamp base can be inserted and removed axially from the socket 24.

FIG. 10B illustrates the lamp base being angularly rotated relative to the socket 24. Upon rotation of the lamp base 24, in the direction indicated by arrow 46, by approximately thirty or more degrees, the contact pins 16 place a compressive force on the spring contacts 28 and come to a stop within the first recess 42 of the spring contacts 28. Stop 33 prevents the arm 32 from rotating beyond the first recess 42. In this locked position, the locking lands 30 extend below the arms 32, preventing the removal or separation of the lamp base axially from the socket 24. The first recess 42 may be sufficiently angled and come into contact with the contact pin 16 so as to require a relatively substantial rotational force so as to prevent unintended rotation of the lamp base relative to the socket 24.

Figure 11:
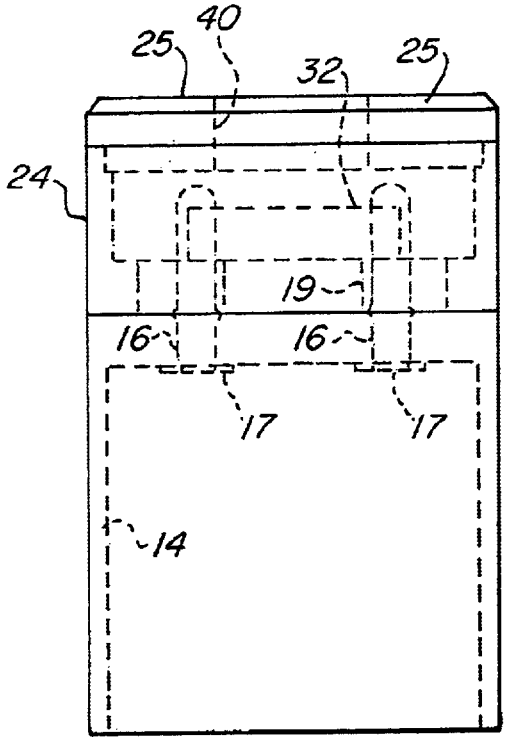
FIG. 11 is a side elevational view of the lamp base and lamp socket.

FIG. 11 is a side elevational view illustrating the lamp base 14 placed within the socket 24.

Figure 12:
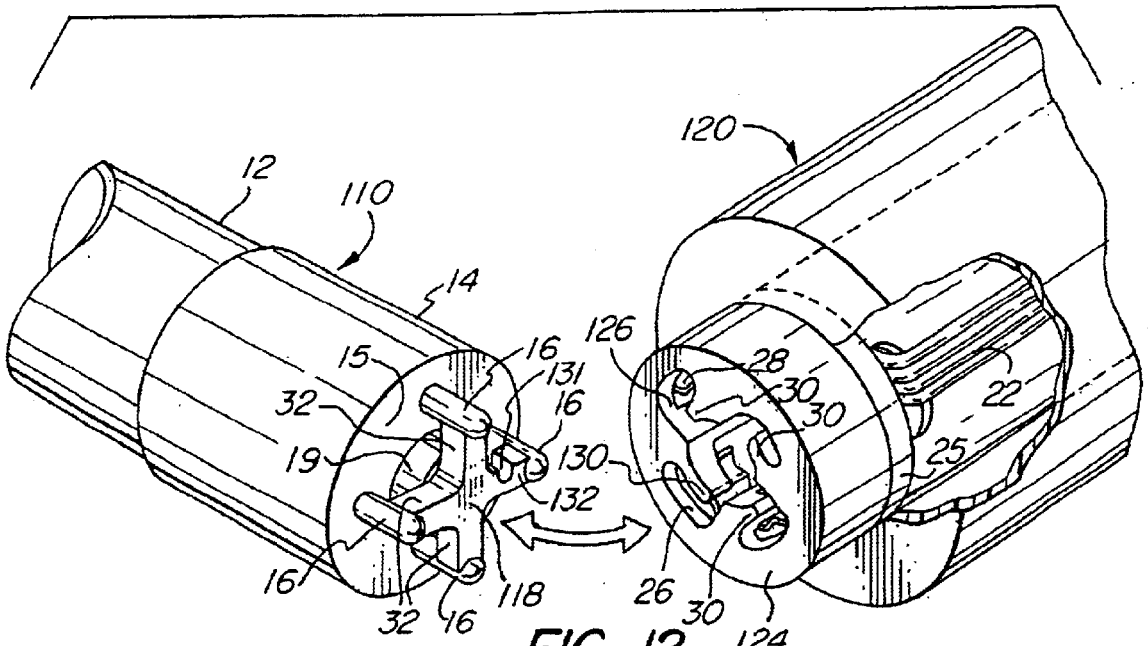
FIG. 12 is a perspective view of a lamp and fixture of another embodiment of the present invention.

FIG. 12 is a perspective view illustrating another embodiment of the present invention. In this embodiment, a key notch 131 and a key pin 130 are used in combination to permit the lamp base and the lamp socket to be attached in only one predetermined angular orientation. Lamp 110 has a base 14 thereon. Placed on base 14 is a locking bridge base 19 having attached thereto a locking bridge 118. Locking bridge 118 has arms 32 and a single notched arm 132. The single notched arm 132 has a key notch 131 placed therein. Fixture 120 has a socket 124. Within socket 124 is a configured opening 126. Formed by opening 126 are locking lands 30. In place of one of the locking lands 30 is formed a key pin 130. The key pin 130 functions as a locking land 30, yet has an extended portion. The extended portion or key pin 130 is adapted to mate with the key notch 131 in the single notched arm 132 of the locking bridge 118 formed on the lamp base 114.

Figure 13:
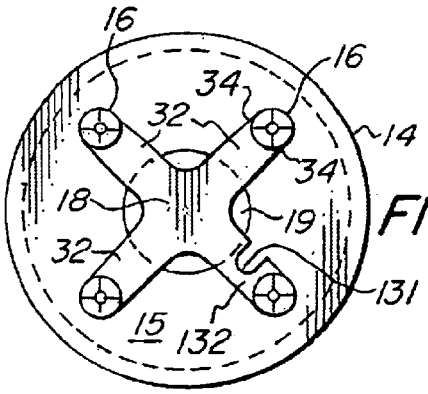
FIG. 13 is a front elevational view of a lamp base of an embodiment of the present invention.

FIG. 13 is a front elevational view illustrating the single notched arm 132 having the key notch 131 formed therein.

Figure 14:
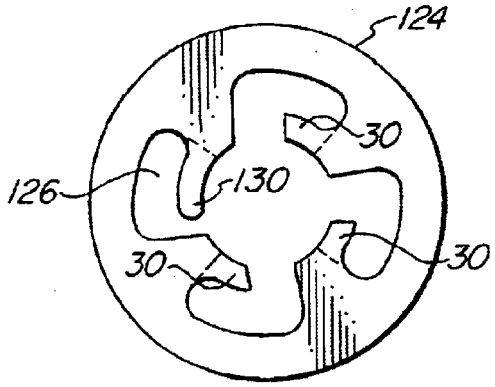
FIG. 14 is a front elevational view of a socket of an embodiment of the present invention.

FIG. 14 is a front elevational view illustrating the socket 124. The socket 124 has an opening 126 with locking lands 30 formed therein and a key pin 130. The key pin 130 has a length greater than the other locking lands 30.

Figure 15A:
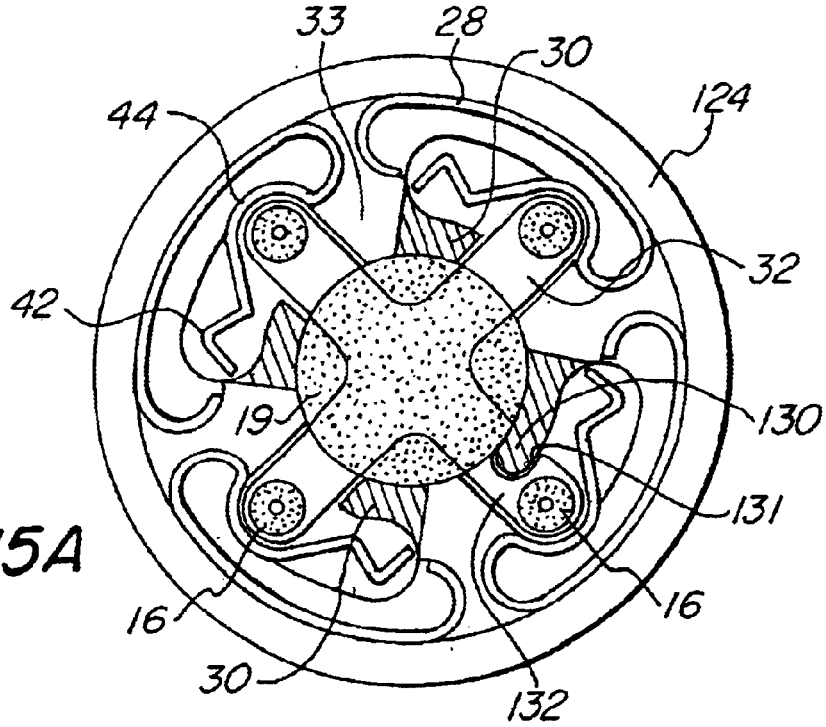
FIG. 15A is a plan view schematically illustrating the operation of an embodiment of the present invention in an unlocked state.
Figure 15B:
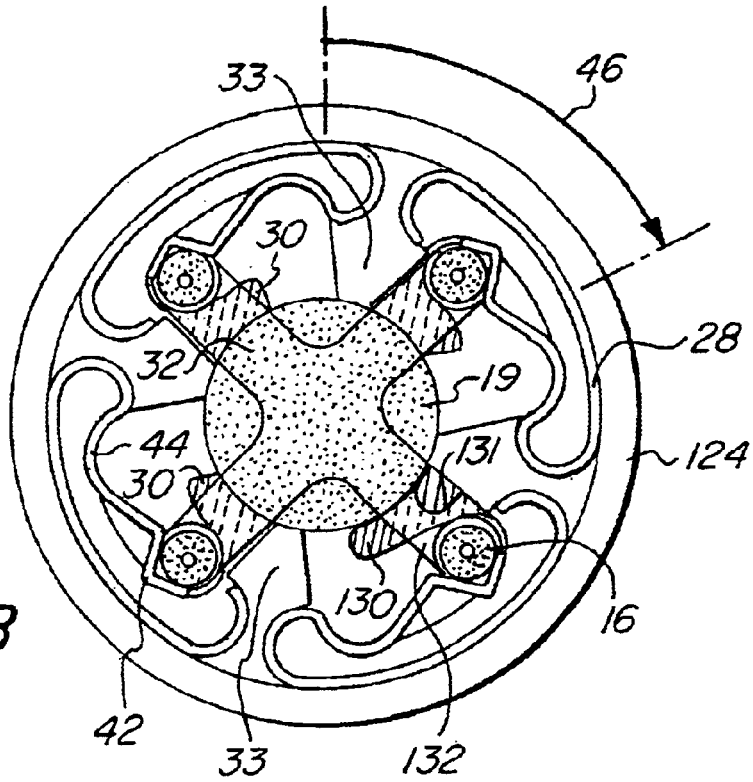
FIG. 15B is a plan view schematically illustrating operation of an embodiment of the present invention in a locked state.

FIGS. 15A and 15B schematically illustrate the operation of this embodiment of the present invention. FIG. 15A illustrates this embodiment of the present invention in an unlocked angular position such that the lamp base and the socket 124 can be separated axially relative to each other. In this unlocked position, the key pin 130 passes through the key notch 131 as the lamp base is axially positioned. The co-action of the key notch 131 and the key pin 130 makes possible only one angular orientation of the lamp base relative to the socket 124. Accordingly, the electrical contacts made between the plurality of contact pins 16 and the spring contacts 28 can only be made in one angular orientation so as to assure that the lamp base and the socket 124 cannot be improperly electrically connected.

FIG. 15B illustrates the socket 124 rotated relative to the lamp base in a direction of arrow 46 by an angle of approximately thirty or more degrees. The locking lands 30 extend under the arms 32 so as to prevent axial movement of the lamp base relative to the socket 124. The key pin 130 also extends under the arm 132 contributing to the secure connection, preventing axial movement. Accordingly, in this embodiment the lamp base 124 and socket can only be combined in a predetermined angular orientation assuring that the proper electrical connections are made between the plurality of contact pins 16 and the spring contacts 28. This is an enhanced safety feature and prevents potential dangerous or damaging electrical connections, assuring proper operation of the lamp.

Figure 16:
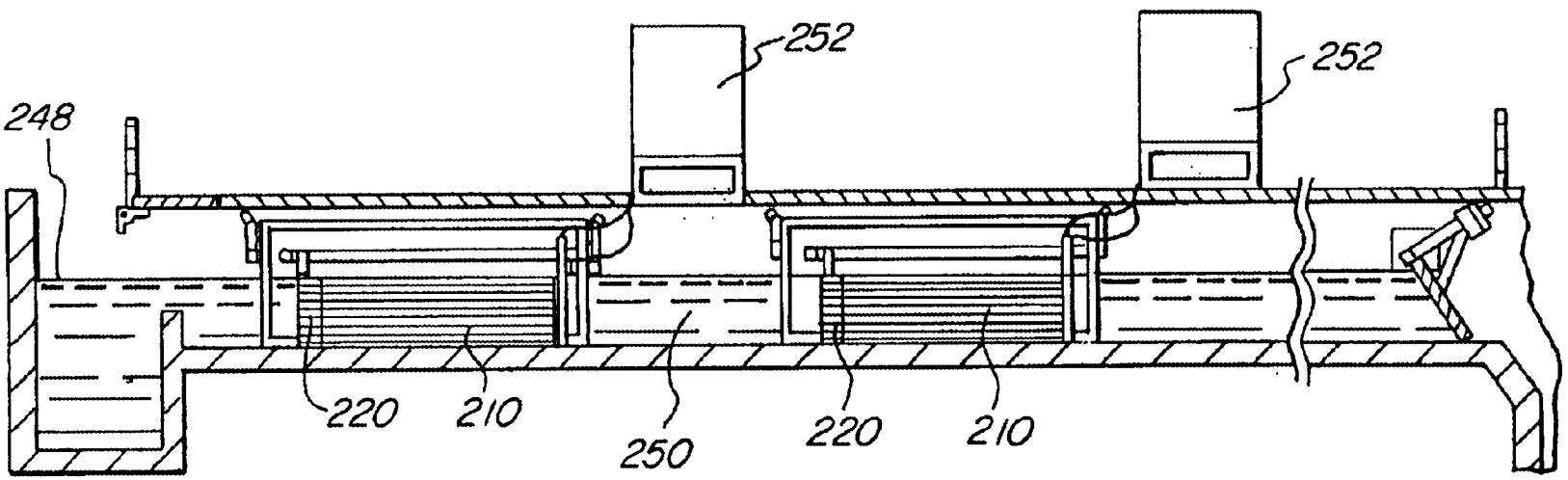
FIG. 16 schematically illustrates the application of the present invention in a water purification system.

FIG. 16 schematically illustrates the application or use of the present invention in a water treatment system. A plurality of germicidal lamps 210, each having a lamp base constructed according to the teachings of the present invention, is connected to fixtures 220. The germicidal lamps 210 are placed within a flow of wastewater 250 contained in a container 248. A lamp control 252 is connected to a bank or plurality of germicidal lamps 210. Ultraviolet radiation generated by the germicidal lamps 210 irradiates any microorganisms or other growth in the wastewater to effectively treat the wastewater 250. The secure locking of the lamp base and socket construction of the present invention is particularly advantageous in applications where there is substantial vibration or movement so as to prevent the unintentional separation of the lamp socket from the lamp base.

While the present invention has been described with respect to an embodiment having four contact pins and in relation to a wastewater treatment system, it should readily be appreciated that the teachings of the present invention can be applied to other similar types of lamps requiring a secure connection between a lamp base and a socket and in other applications. Accordingly, it should be readily appreciated that various modifications may be made without departing from the spirit and scope of the invention.

What is claimed is:

1. A locking lamp base and socket comprising:

a lamp base:

a plurality of contact pins connected to said lamp base extending from a surface;

a bridge extending between pairs of said plurality of contact pins;

a gap formed between the surface of said lamp base and said bridge;

a socket;

an opening in said socket adapted to receive said plurality of contact pins and said bridge; and a locking land in said socket adapted to extend into said gap, whereby when said locking land extends into said gap, relative axial movement between said lamp base and said socket is prevented.

2. A locking lamp base and socket as in claim 1 further comprising:

a notch formed in said bridge; and a pin adapted to mate with said notch formed on said locking land, whereby said plurality of contact pins and said bridge are capable of fitting within said opening in a predetermined angular orientation.

3. A locking lamp base and socket as in claim 1 further comprising:

a spring contact having recesses adapted to mate with each of said plurality of contact pins.

4. A locking lamp base and socket as in claim 1 wherein:

said bridge comprises a bridge support connected to the surface of said lamp base and a plurality of arms connected to said bridge support extending radially therefrom.

5. A locking lamp base and socket as in claim 4 further comprising:

fingers attached to each of said plurality of arms, said fingers extending around a circumferential portion of a respective one of said plurality of contact pins.

6. A locking lamp base and socket as in claim 1 wherein:

said plurality of contact pins comprises four contact pins.

7. A locking lamp base and socket as in claim 6 wherein:

said bridge comprises an X-shape having four arms.

8. A locking lamp base and socket as in claim 7 further comprising:

fingers placed on the end of each of said four arms, said fingers extending around a circumferential portion of a respective one of said plurality of contact pins.

9. A locking lamp base and socket as in claim 1 further comprising:

a gas discharge lamp attached to said lamp base.

10. A locking lamp base and socket as in claim 9 wherein:

said gas discharge lamp comprises a fluorescent lamp.

11. A locking lamp base and socket as in claim 9 wherein:

said gas discharge lamp comprises a germicidal lamp.

12. A locking lamp base and socket comprising:

a lamp base having a surface;

a plurality of contact pins connected to said lamp base extending from the surface;

a bridge extending between pairs of said plurality of contact pins over the surface forming a gap between said bridge and the surface;

a socket;

an opening in said socket adapted to pass through said plurality of pins and said bridge and permitting said lamp base to be rotated relative to said socket;

a plurality of spring clips adapted to mate with said plurality of contact pins; and a locking land formed on said socket and adapted to extend under said bridge into the gap between said bridge and the surface, whereby when said lamp base is rotated relative to said socket, said plurality of contact pins engage said plurality of spring clips and said locking lands extend under said bridge into the gap between said bridge and said surface.

13. A locking lamp base and socket as in claim 12 further comprising:

a notch formed in said bridge; and a pin adapted to mate with said notch formed on said locking land, whereby said plurality of contact pins and said bridge are capable of fitting within said opening in a single predetermined angular orientation.

14. A locking lamp base and socket as in claim 12 further comprising:

a gas discharge lamp attached to said lamp base.

15. A locking lamp base and socket for axially securing the lamp base to the socket comprising:

a gas discharge lamp;

a lamp base having a surface attached to an end of said gas discharge lamp;

a plurality of contact pins connected to said lamp base extending from the surface;

a bridge support attached to the surface of said lamp base;

a plurality of arms attached to said bridge support, said plurality of arms extending between pairs of said plurality of contact pins over the surface forming a gap between each of said plurality of arms and the surface;

fingers attached to a distal end of each of said plurality of arms, said fingers extending around a circumferential portion of a respective one of said plurality of contact pins;

a socket;

an opening in said socket adapted to pass through said plurality of pins and said plurality of arms, said opening permitting relative rotational movement between said lamp base and said socket;

a plurality of spring clips adapted to mate with said plurality of contact pins; and a plurality of locking lands formed on said socket, said plurality of locking lands adapted to extend under said plurality of arms into the gap between said plurality of arms and the surface when said lamp base is rotated relative to said socket, whereby when said lamp base is rotated relative to said socket, said plurality of contact pins engage said plurality of spring clips and said locking lands extend under said plurality of arms into the gap between said bridge and said surface.

16. A locking lamp base and socket for axially securing said lamp base to said socket as in claim 15 further comprising:

a notch formed in one of said plurality of arms; and a pin adapted to mate with said notch formed on said locking land, whereby said plurality of contact pins and said bridge are capable of fitting within said opening in a single predetermined angular orientation.

17. A lamp assembly adapted to be locked within a lamp socket comprising:

a lamp;

a lamp base having a surface, said lamp base attached to an end of said lamp;

a plurality of contact pins connected to said lamp base and extending from the surface; and a bridge extending between pairs of said plurality of contact pins over the surface forming a gap between said bridge and the surface, whereby a portion of the lamp socket is capable of extending under the gap preventing relative axial movement between said lamp base and the lamp socket.

18. A lamp assembly adapted to be locked within a lamp socket as in claim 17 further comprising:

a key notch placed within said bridge, whereby said key notch is capable of mating with a key pin formed on the lamp socket.

* * * * *